US007871302B2

(12) United States Patent
Provost

(10) Patent No.: US 7,871,302 B2
(45) **Date of Patent: *Jan. 18, 2011**

(54) OUTBOARD MOTOR WITH REVERSE SHIFT

(76) Inventor: Brian Provost, 9104 Choupique Rd., Loreauville, LA (US) 70552

( * ) Notice: Subject to any disclaimer, the term of this patent is extended or adjusted under 35 U.S.C. 154(b) by 0 days.

This patent is subject to a terminal disclaimer.

(21) Appl. No.: 12/383,290

(22) Filed: Mar. 23, 2009

(65) Prior Publication Data

US 2009/0191774 A1 Jul. 30, 2009

Related U.S. Application Data

(63) Continuation of application No. 11/879,112, filed on Jul. 16, 2007, now Pat. No. 7,662,005, which is a continuation-in-part of application No. 11/698,003, filed on Jan. 24, 2007, now abandoned, which is a continuation of application No. 11/156,184, filed on Jun. 20, 2005, now abandoned, which is a continuation of application No. 10/389,157, filed on Mar. 14, 2003, now Pat. No. 6,921,305.

(51) Int. Cl.

| | |
|---|---|
| ***B63H 5/125*** | (2006.01) |
| ***B63H 20/08*** | (2006.01) |
| ***B63H 20/12*** | (2006.01) |
| ***B63H 25/00*** | (2006.01) |

(52) U.S. Cl. ..... 440/53; 440/58; 440/63; 114/144 R

(58) Field of Classification Search ..... 440/53, 440/57–60, 61 S–61 C, 63, 64, 75, 76; 114/144 R
See application file for complete search history.

(56) References Cited

U.S. PATENT DOCUMENTS

| | | | | |
|---|---|---|---|---|
| 2,096,457 | A | 2/1934 | Irgens | |
| 2,549,481 | A | 4/1951 | Kiekhaefer | |
| 2,739,561 | A | 10/1951 | Kiekhaefer | |
| 2,732,819 | A | 1/1956 | Irgens | |
| 3,310,021 | A * | 3/1967 | Shimanckas | 440/86 |
| 3,628,492 | A | 12/1971 | Baldwin et al. | |
| 3,799,102 | A * | 3/1974 | Smith | 440/60 |
| 4,232,627 | A | 11/1980 | Glenn et al. | |
| 4,826,459 | A | 5/1989 | Slattery | |
| 4,878,864 | A | 11/1989 | Van Bentem | |
| 6,220,905 | B1 | 4/2001 | Blanchard | |
| 6,352,456 | B1 | 3/2002 | Jaszewki et al. | |
| 7,662,005 | B2 * | 2/2010 | Provost | 440/53 |

* cited by examiner

*Primary Examiner*—Ajay Vasudeva
(74) *Attorney, Agent, or Firm*—Keaty Law Firm

(57) ABSTRACT

An outboard motor for small watercraft, such as a pleasure boat, has a capability of changing between a forward shift position and a reverse shift position by causing a lower part of the unit to rotate in small increments and move along an arc formed by a ratchet plate secured above the propeller assembly.

3 Claims, 12 Drawing Sheets

OUTBOARD MOTOR WITH REVERSE SHIFT

CROSS REFERENCE TO RELATED APPLICATIONS

This application is a continuation of my application Ser. No. 11/879,112 filed on Jul. 16, 2007, now U.S. Pat. No. 7,662,005, which is a continuation-in-part of my application Ser. No. 11/698,003 filed on Jan. 24, 2007 (abandoned), which is a continuation of application Ser. No. 11/156,184, filed on Jun. 20, 2005, now abandoned, which is a continuation of application Ser. No. 10/389,157 filed on Mar. 14, 2003, now U.S. Pat. No. 6,921,305, the full disclosures of which are incorporated by reference herein and the priority of which is hereby claimed.

BACKGROUND OF THE INVENTION

This invention relates to outboard motors, and more particularly to a drive unit for use with the watercraft, such as a pleasure boat, with the capability to shift gears between a forward position and a reverse position.

Conventional marine outboard drive units are supported on the transom of a boat and can be pivoted to move in a generally horizontal plane, left and right, within a 45-90 degree arc. The outboard motors include a transmission mechanism for transmitting rotational power of the crankshaft of an engine to a propeller through a drive shaft. As a general rule, smaller outboard motors can propel the boat in a forward direction, with only a forward-shift capability. The larger motors that allow reverse movement of the boat are typically large, expensive, and have complicated gear-switching mechanisms.

An additional problem experienced by motor craft when running in shallow or muddy waters, is that the water body has overgrowth of vegetation which catches on the propeller and makes forward movement extremely difficult. Another problem is the possibility of the propeller striking rocks or other hard underwater objects causing severe damage to the propeller unit.

Still another problem that is encountered when using a small outboard motor unit is that when it is mounted on a tall transom boat the skeg of the propeller is insufficiently submerged to provide an effective steering on the water.

A further problem experienced with outboard motor units is the buildup of pressure inside the gearbox and the stuffing box, which results from the rotation of the shaft and the gears. The buildup of hot air pressure causes the seals to leak and allows water to enter resulting in inevitable danger to bearings and the gear.

SUMMARY OF THE INVENTION

The present invention contemplates elimination of drawbacks associated with the conventional outboard motor unit and provision of an outboard drive unit that can be inexpensively modified or retrofitted to allow changing of the shift position between a forward shift position and a reverse shift position in an easy manner.

Another object of the present invention is to provide an outboard drive unit that can be used with a conventional watercraft, such as a pleasure boat, for operation in deep water, as well as shallow waters, in mud conditions, and in water bodies with rocky bottoms or water bodies with vegetation.

It is another object of the present invention to provide an outboard drive unit that allows equalization of pressure between the exterior and interior of the gearbox and allows the hot air to escape the gearbox at a point above the water surface.

It is still another object of the present invention to provide a skeg extension member which allows the outboard motor to be mounted on tall transom boats.

These and other objects of the present invention are achieved through a provision of an outboard drive unit adapted to be mounted on a transom of a boat, which comprises an upper unit that houses a motor with a drive shaft and a lower unit comprising an input shaft operationally connected to the drive shaft. The upper unit is adapted for pivotal movement in a generally horizontal plane in relation to the boat transom, moving in an arc of between 45-90 degrees.

An attachment plate is mounted below the upper unit and an engagement plate is mounted above the propeller assembly. The engagement plate being secured to the propeller assembly is adapted for a limited rotational movement with the attachment plate when the operator changes the shift position between the forward shift position to the reverse shift position. The outboard motor unit also comprises a means for changing the shift position of the lower unit between a forward shift position and a reverse shift position when manipulated by an operator. A ratchet plate is mounted between the attachment plate and the engagement plate and a spring-loaded stop pin releasably engages the ratchet plate when the lower unit is in a forward shift position or in a reverse shift position.

The ratchet plate is provided with a plurality of spaced-apart slots, each slot having a sloped surface, or ramp, and the stop pin is adapted to slide within said slots when the upper unit is pivoted during changing of the shift position. There are two "locating" openings made in the ratchet plate, the pin engages one of the openings when the lower unit is in a forward shift position, and engages the diametrically-opposite opening when the lower unit is in a reverse shift position, with the propeller facing the boat transom.

The input shaft, which transmits the rotational force from the motor drive shaft to the propeller shaft is at least partially mounted in a sealed protective housing. A portion of the input shall is sized to have at least a part thereof extend above a water surface. A pressure release opening is formed in the input shaft for allowing gas to escape the protective housing at a location above the water surface.

The propeller assembly comprises a stuffing tube housing a propeller shaft operationally connected to the input shaft, a cavitation plate secured to the propeller shaft and a skeg secured to the propeller shaft and extending downwardly therefrom. The skeg has a generally planar configuration and an outer rounded edge to facilitate unimpeded movement of the skeg in a vegetation-covered body of water. An optional skeg extension member is provided for detachable securing to a top edge of the skeg and allow the outboard motor, unit to be used with tall transom boats, while ensuring that the skeg is fully submerged below water surface during motion in the body of water. The skeg extension member has a bottom part configured for detachable securing to the top edge of the skeg and an outer part configured as an extension of the skeg outer edge, said outer part having a curved surface to facilitate unimpeded movement of the skeg extension member in a vegetation-covered body of water.

An optional stabilizing member is secured on the skeg to compensate for directional force acting on said outboard motor drive unit during rotation of the propeller. The outboard motor unit of the instant invention may be optionally equipped with a detachably securable propeller guard assembly for preventing damage of the propeller by hard objects located in a body of water.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
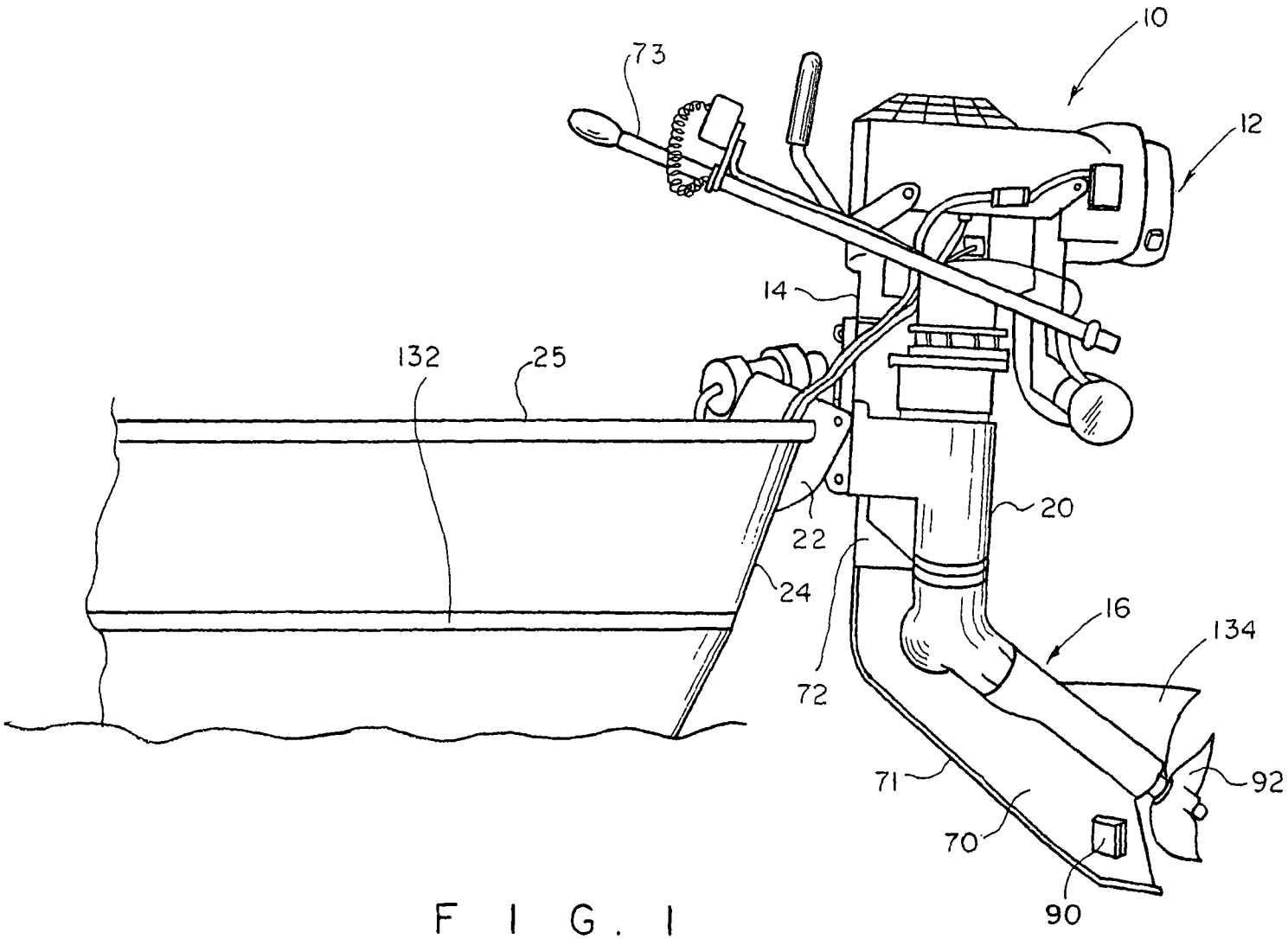
FIG. 1 is a perspective view of the outboard motor unit in accordance with the present invention mounted on a boat transom, with gear shifted into a forward position.
Figure 2:
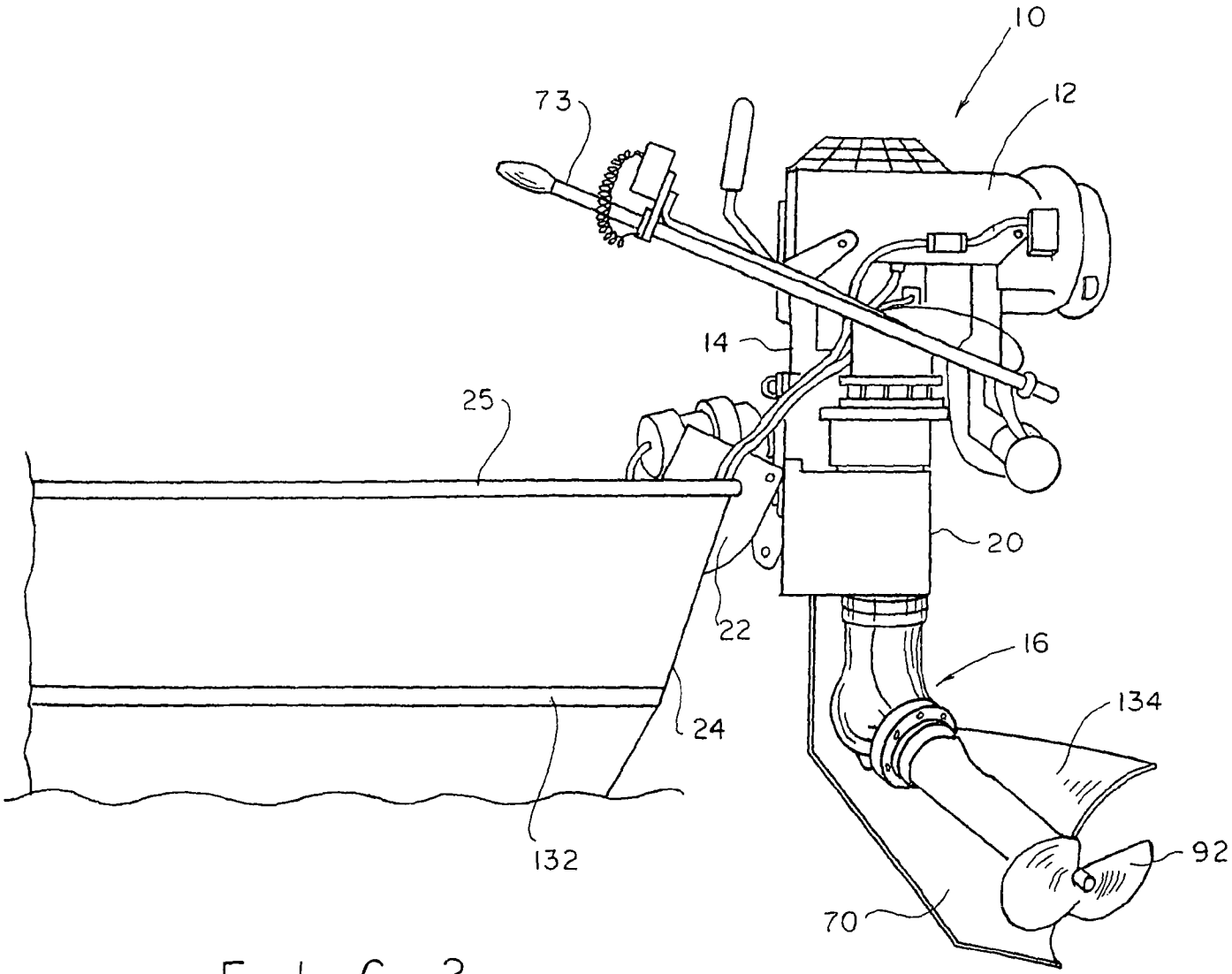
FIG. 2 is a perspective view of the outboard motor apparatus of the present invention, wherein the lower portion of the motor unit has been pivoted by about 45 degrees in relation to the forward shift position of FIG. 1.
Figure 3:
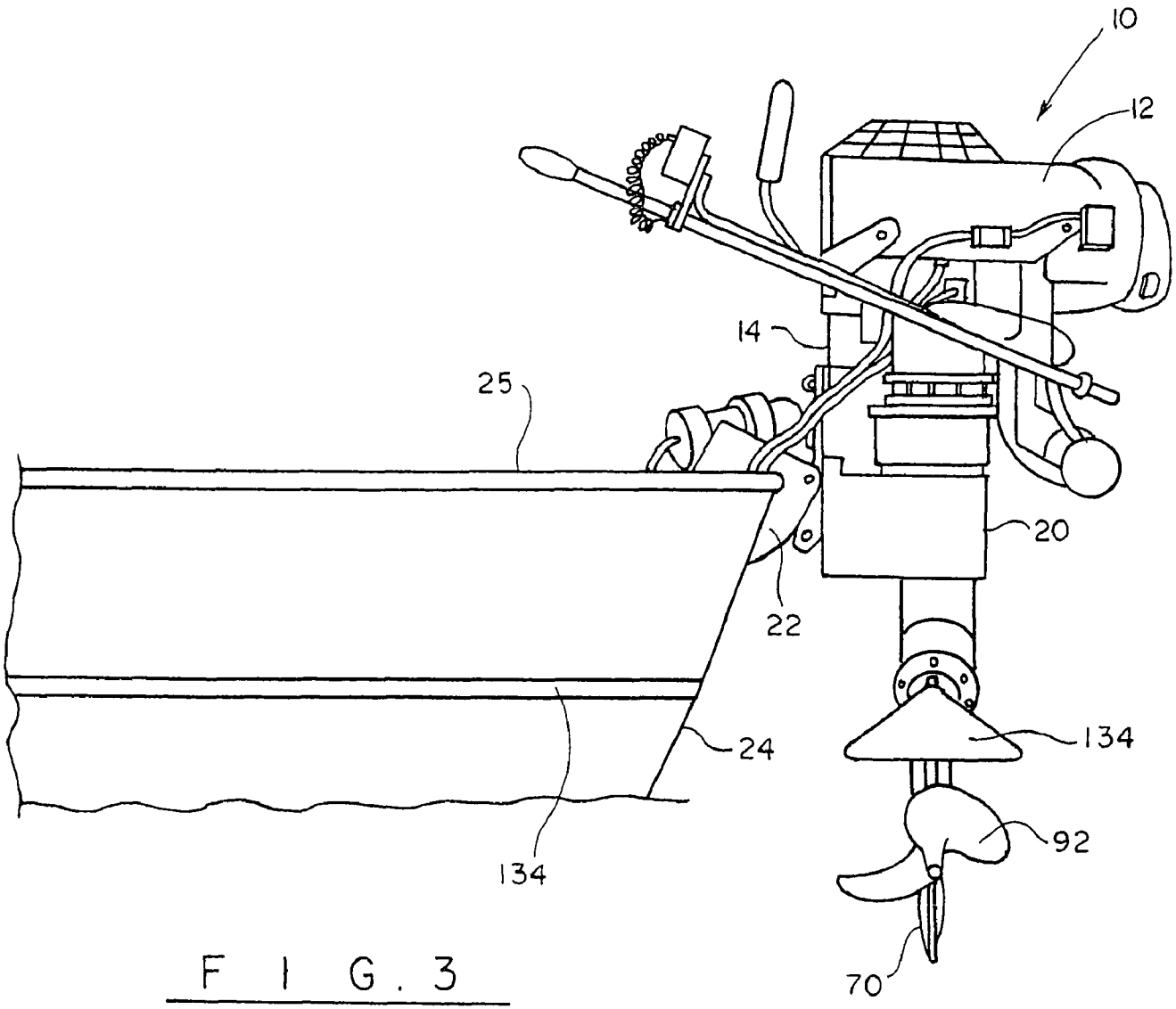
FIG. 3 is a perspective view of the outboard motor of the present invention where the lower part of the unit has been pivoted by an additional 45 degrees in relation to the position shown in FIG. 2.

Turning now to the drawings in more detail, numeral 10 designates the outboard drive unit of the present invention. The outboard motor 10 comprises an upper unit, or power head 12, the drive shaft housing 14, and the lower unit 16. The upper unit 12 includes an internal combustion engine of a conventional design, for instance an inline two-cylinder engine that operates on a 4-stroke combustion principle. Similar to conventional engines, the engine employed in the design of the present invention has reciprocating cylinders moving within the combustion chambers and moving a drive shaft 18. The drive shaft transmits rotational force to the lower unit 16 through an input shaft 18 mounted in the lower unit housing 20. The engine 12 is connected to a fuel supply system (not shown) that supplies the fuel charge to the combustion chambers for allowing blending of the fuel and release of gases out of the combustion chambers. Although not shown, it is within the knowledge of those skilled in the art that the engine 12 is also connected to a cooling systems that is conventionally employed for operation of these types of motors.

The lower unit 16 comprises a support assembly 22 which supports the drive unit 10 on the transom 24 of a watercraft 25. The support assembly 22 orients the lower unit with associated propeller assembly such that the propeller is submerged when the watercraft is stationary on a body of water.

The lower unit 16 is secured to the engine portion 12 by an attachment assembly which comprises a plurality of retainer lugs 26 extending downwardly from an upper attachment plate 30. The attachment lugs 26 are adapted for engagement with a lower attachment plate 32 by extending through corresponding openings 33 formed in the lower attachment plate 32. The lower attachment plate 32 is positioned below an automatic clutch 35 which is of a conventional design.

Figure 6:
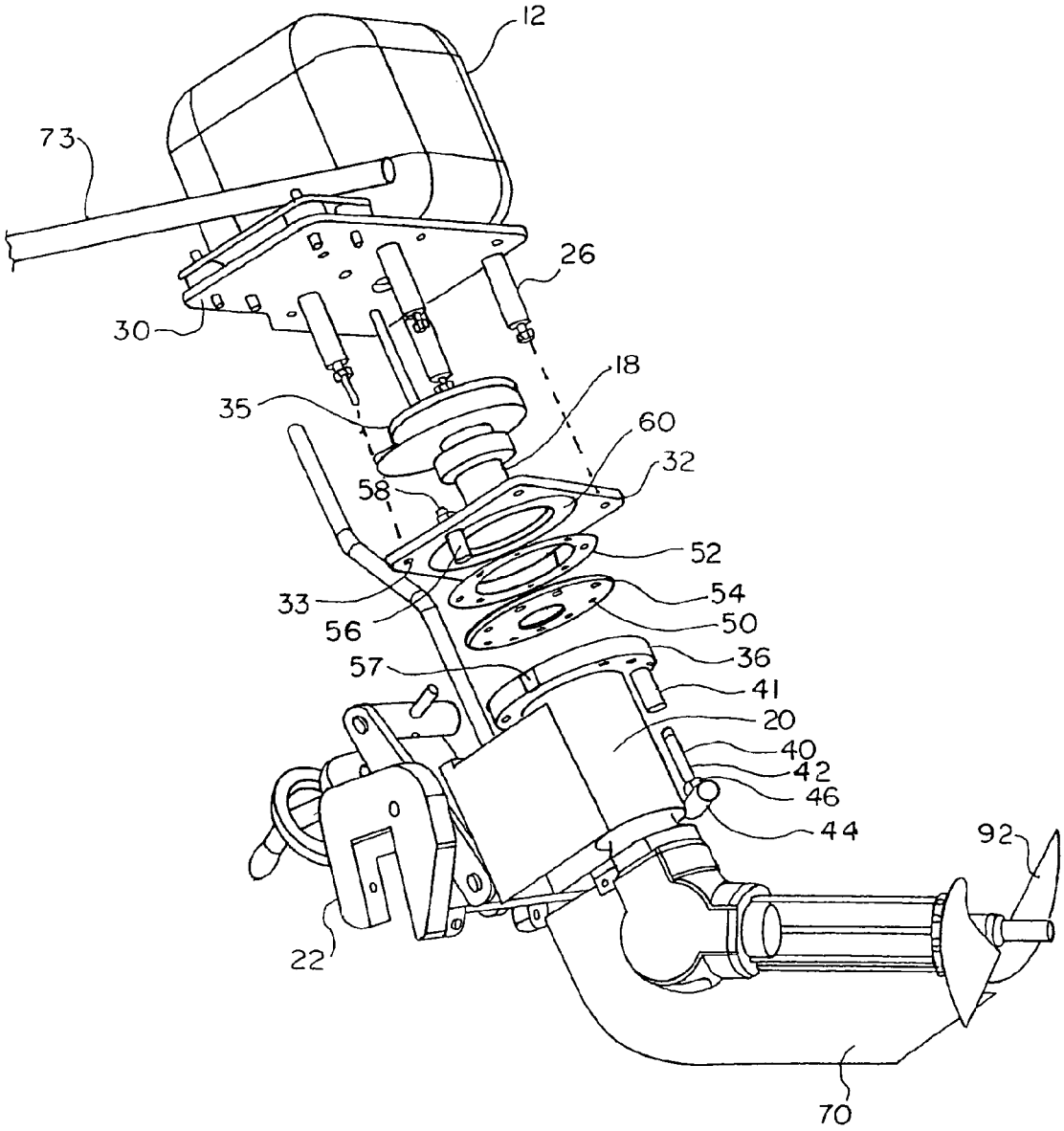
FIG. 6 is an exploded view of the outboard motor unit in accordance with the present invention.

Securely attached to the top of the housing 20 is a stationary engagement plate 36 that has an outer peripheral edge provided with a pair of opposed cutouts 57 (FIG. 6). A pair of stabilizing lugs 56 is detachably engaged with the lower attachment plate 32. The lugs 56 fit within the cutouts 57 to stabilize the position of the upper unit 12 on the lower unit 16. A bolt 58 mounted on the upper end of each lug 56 prevents the lugs 56 from disengagement with the lower engagement plate 32. The lugs 56 prevent the motor 12 from freely rotating in relation to the lower unit 16 while permitting a limited pivotal movement in relation thereto.

Extending downwardly from the bottom surface of the engagement plate 36 is a hollow pin-receiving sleeve 41 which are sized and configured for receiving in a reciprocal sliding engagement, a stop pin 40. The pin 40 has a handle 44 and is spring-loaded with a compression spring 42. The stop pin 40 is movable within the sleeve 41 and is prevented from disengagement from the sleeve 41 by a nut 46 mounted between the handle 44 and the compression spring 42. The stop pin 40 forms a part of a means for changing shift position from a forward shift to a reverse shift, as will be explained in more detail hereinafter.

The shift changing means also comprises a ratchet plate 50, which is mounted for rotation in relation to the engagement plate 36. The lower attachment plate is provided with a counter bore 60 on its bottom surface, and a ring-shaped spacer plate 52 may be positioned within the counter bore 60 between the lower attachment plate 32 and the ratchet plate 50. If desired, the depth of the counter bore 60 can be selected to receive the spacer plate 52 and the ratchet plate 50 therein. The ratchet plate 50 is provided with a pair of openings, or locating holes 54. The stop pin 40 fits in one or another of the openings 54, depending on whether the lower unit is shifted for forward shift or reverse shift.

Figure 14:
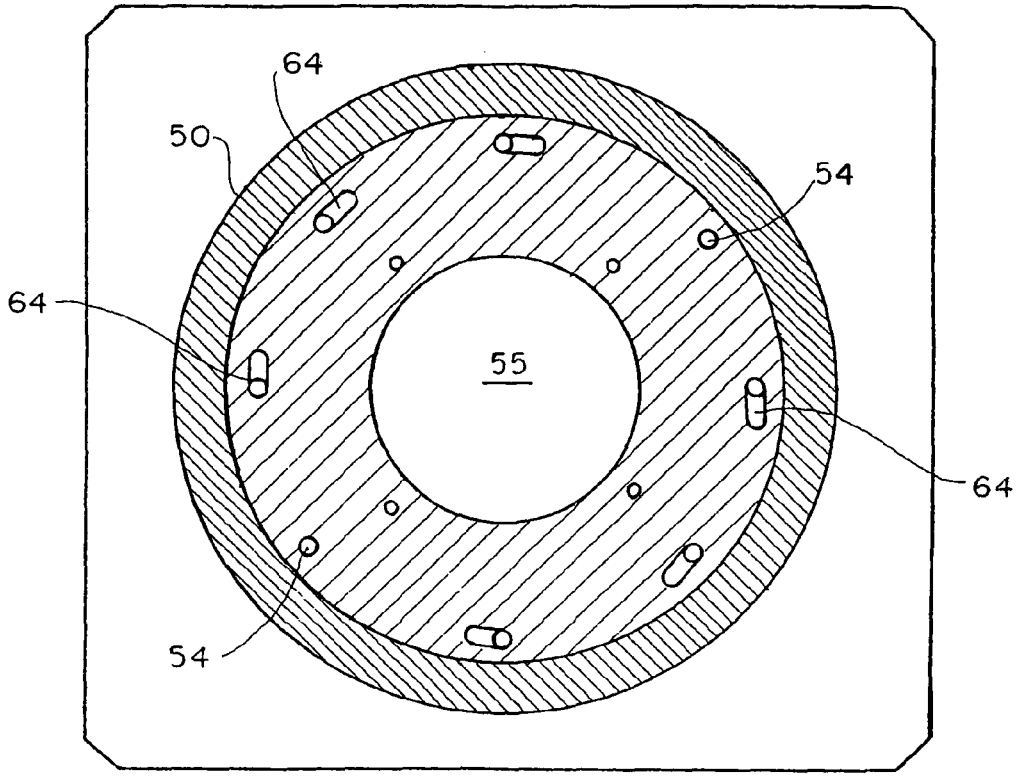
FIG. 14 is a plan view of the ratchet plate of the apparatus of the present invention.
Figure 15:
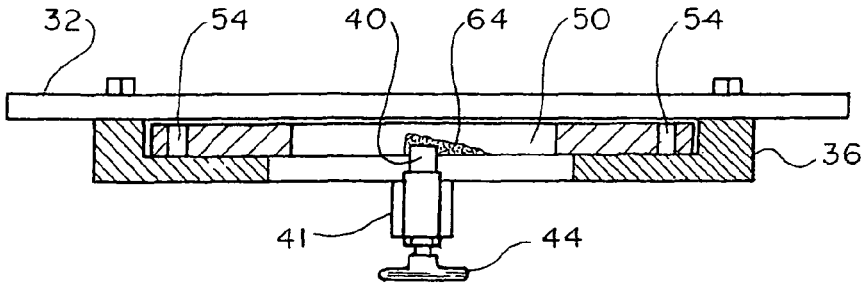
FIG. 15 is a side view of the ratchet plate engageable by the ratchet, or stop pin.

As shown in detail in FIG. 14, the ratchet plate 50 comprises a ring-shaped body with a central opening 55 therein. The diametrically opposing locating openings 54 are adapted for receiving the stop pin 40. A plurality of slots or cutouts 64 are formed about the circumference of the ratchet plate 50. The slots 64 have sloping surfaces, forming a ramp in each slot. After the stop pin 40 is pulled down and released from its normal engagement with one of the locating openings 54, the operator can pivot the upper unit 12 in relation to the boat transom and the ratchet plate 50, moving the pin 40 along an arcuate path between adjacent slots 64.

When the boat is in a forward shift position, such as shown in FIG. 1, the stop pin 40 is engaged within the sleeve 41 and within one of the locating holes 54. When the boat operator grips the handle 73, which is secured to the upper unit 12, while pulling down on the handle 44, the pin 40 is released from the sleeve 41. The upper unit 12 is now free to pivot about the axis of the input shaft 18 in a generally horizontal plane, while the lower unit 16 is free to rotate in relation to the upper unit and the boat transom.

Figure 4:
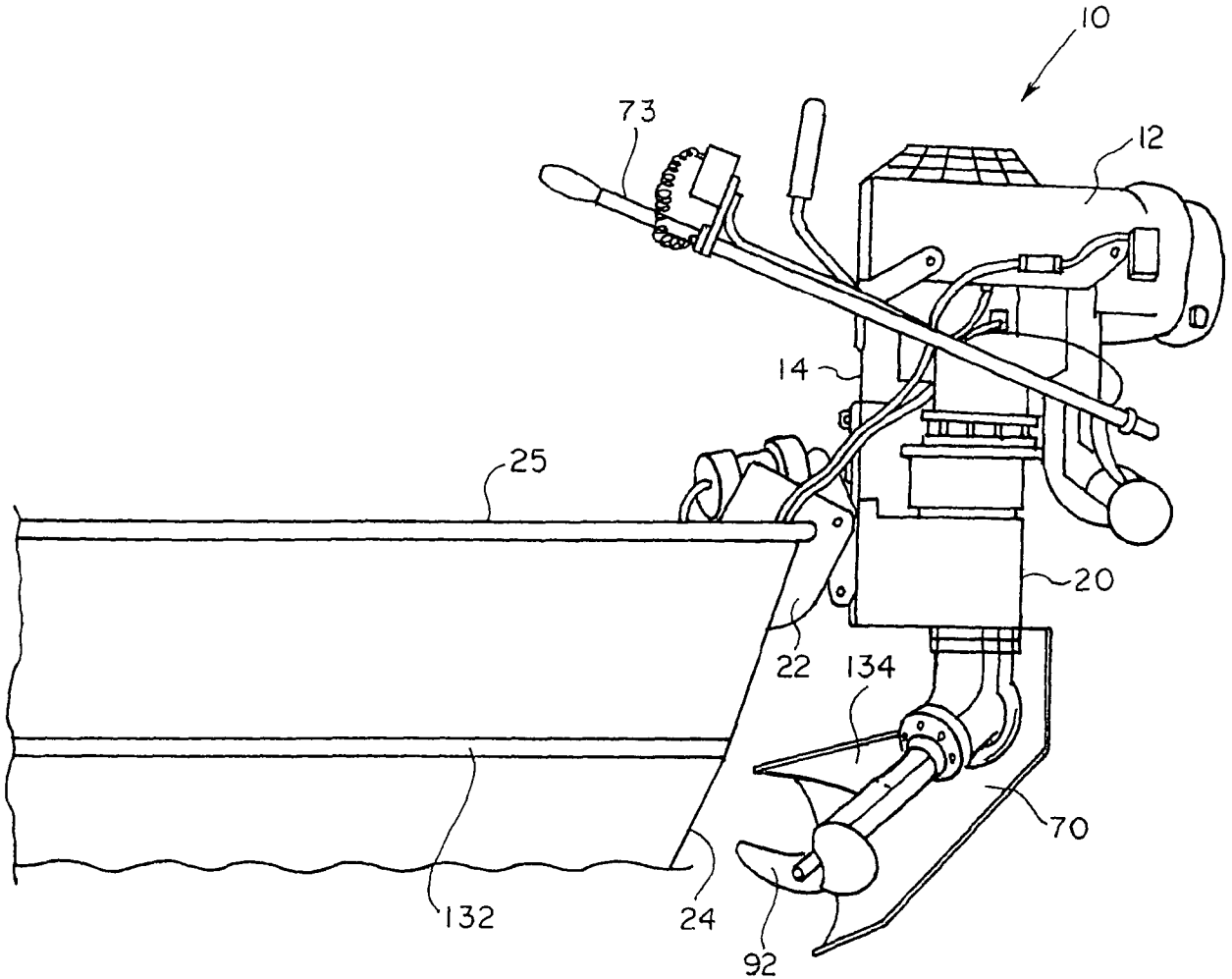
FIG. 4 shows additional rotation of the lower part of the outboard motor unit.
Figure 5:
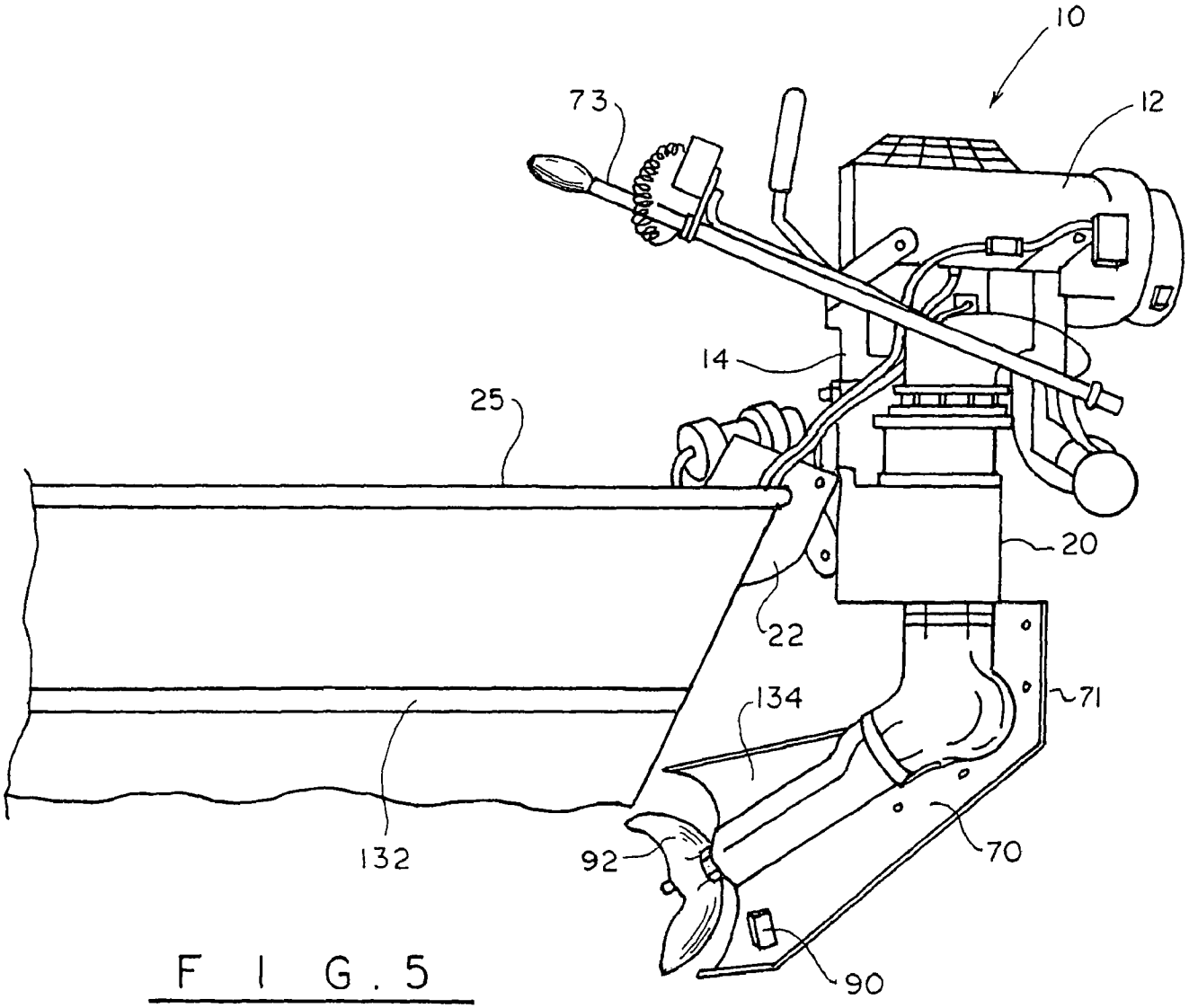
FIG. 5 is a perspective view of the outboard motor unit in accordance with the present invention, with the propeller shaft oriented for reverse shift position.

By repeatedly pulling on the handle 73, the user causes the motor 12 to pivot along a limited arc of about 45 degrees, causing the pin 40 to slide into one of the cutouts 64. Another pivotal movement of the handle 73 causes the pin 40 to move into the next adjacent slot 64 while the lower unit rotates. By repeatedly pivoting the upper unit 12, the user causes the lower unit 16 to move from the position shown in FIG. 1 to a position shown in FIG. 4. At that time, the lower unit 16 has turned 180 degrees, such that the engagement pin 40 is now engaged with a diametrically opposite locating slot 64. The propeller shaft is now oriented toward the bottom of the boat and the propeller 92 faces the boat transom. The boat can now move in a reverse direction.

Figure 7:
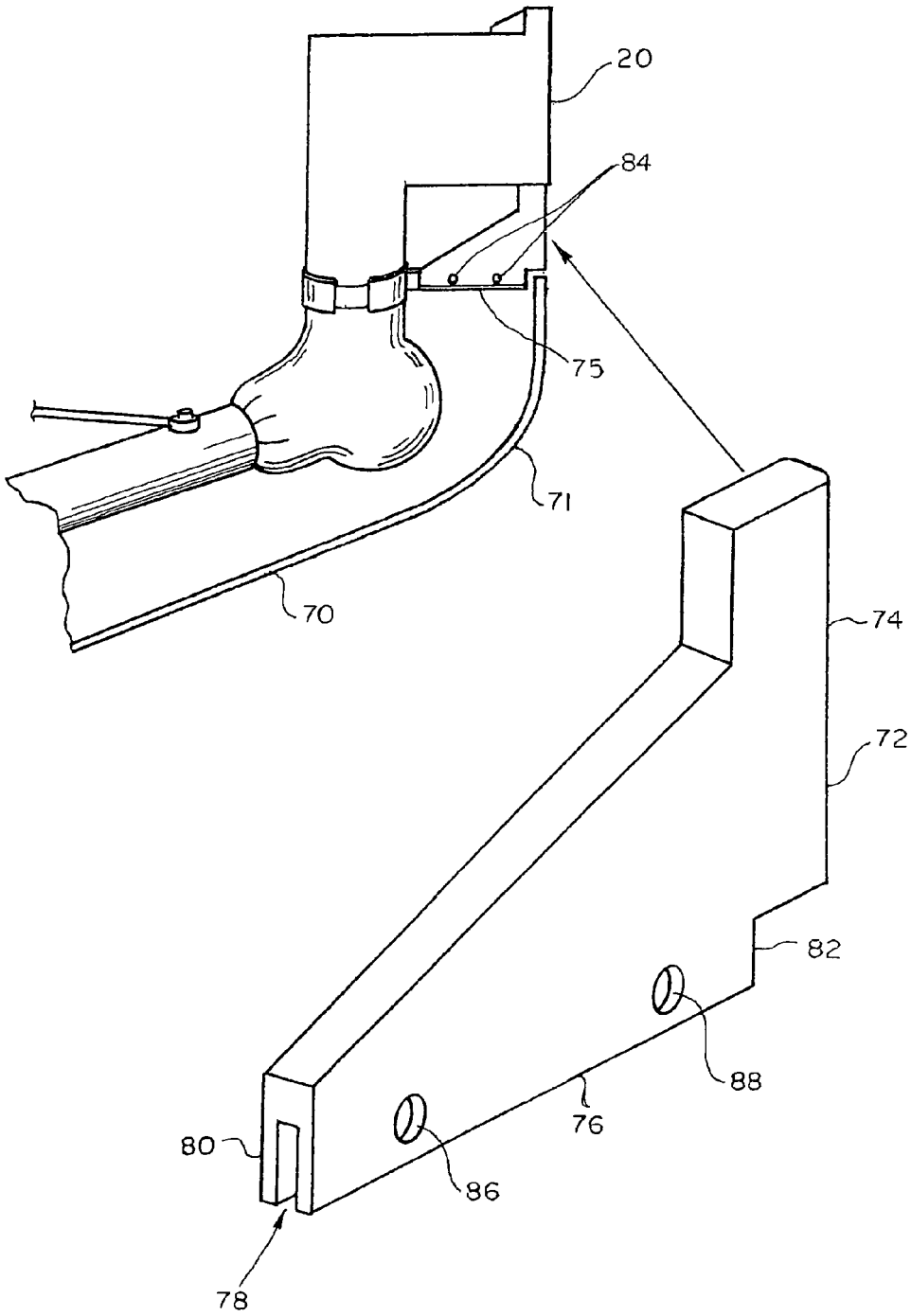
FIG. 7 is a detail view illustrating the skeg extension member.

Turning now to the optional skeg extension member 72 shown in FIG. 7, the skeg extension member is designed for positioning between the housing 20 and a skeg 70. The skeg extension member 72 is an irregularly shaped body having vertical dimensions sufficient to lower the position of the skeg 70 to cause it to submerge below the water surface 132 when the outboard motor unit 10 is used with a tall transom boat.

The skeg extension member 72 has an outer wall 74 which is curved to follow a curved configuration of an outer edge 71 on the skeg 70. The curved edges 71 and curved outer wall 74 help the skeg move through vegetation with a sliding motion as opposed to conventional sharp edge skegs that attempt to cut through vegetation. The rounded edge facilitates movement through the vegetation-covered body of water without having to extend additional motor energy to cut through grass and small branches.

A bottom part 76 of the skeg extension member 72 is provided with a slot 78 extending from an inner end 80 and to the outer edge 82. The inverted U-shaped cutout 78 is designed to allow the skeg extension member 72 to be mounted on a top 75 of the skeg proper, as shown in FIG. 7. A pair of bolts, or other securing members 84 is engaged with corresponding openings 86 and 88 formed in the bottom of the skeg extension member 72 for securing the skeg extension member 72 to the skeg 70.

Figure 10:
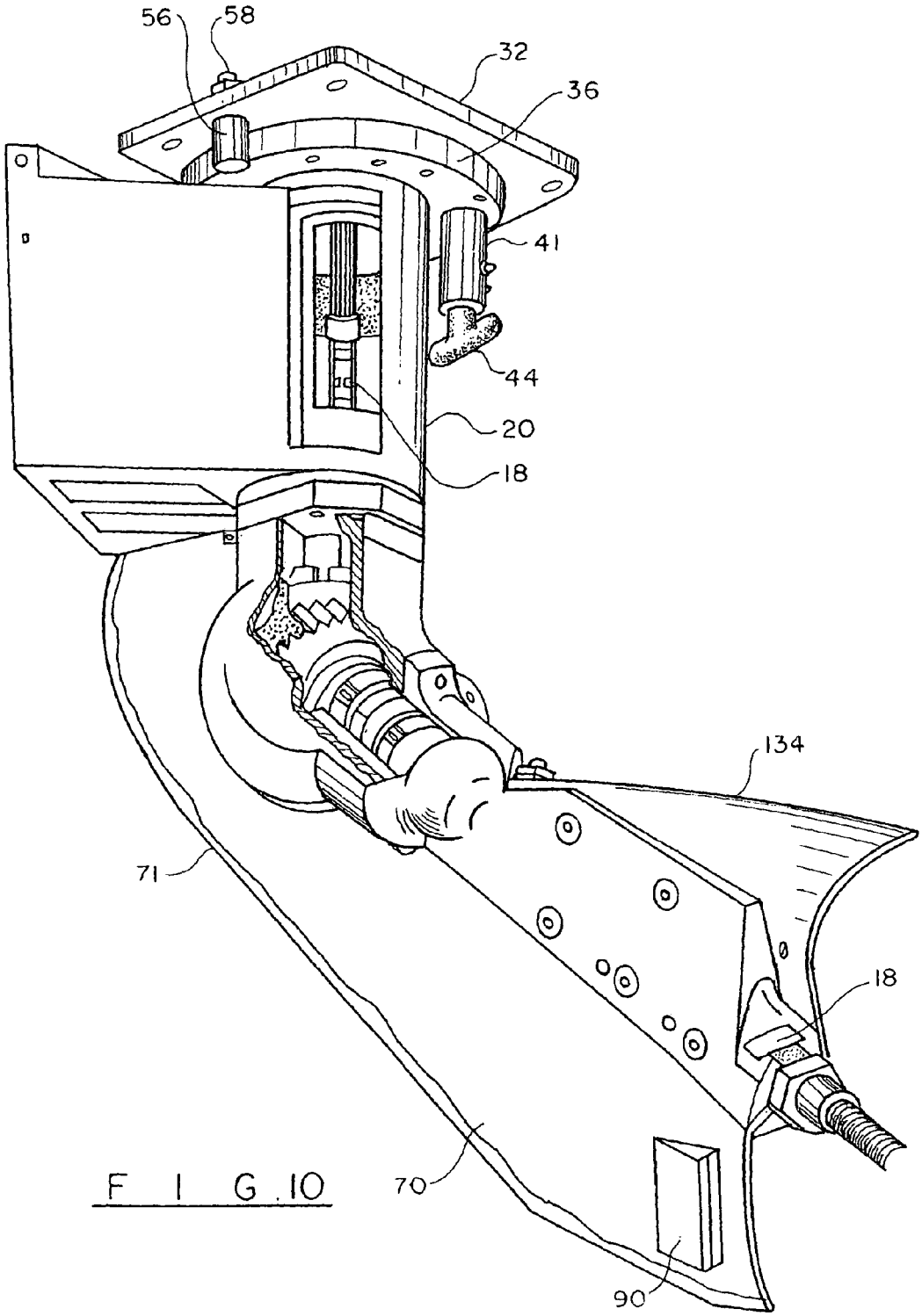
FIG. 10 is a perspective, partially cutaway view illustrating the lower part of the outboard motor unit of the present invention.

A wedge-shaped stabilizing member 90, shown in FIGS. 1 and 10, can be attached on one surface of the skeg 70. The wedge-shaped stabilizing member 90 compensates for the directional force acting on the outboard motor unit 10 during rotation of the propeller. The rotating propeller 92, depending on the direction of its rotation, tends to "pull" the boat in one direction. The stabilizing member 90 is adapted to keep the propeller 92 from "walking left" when the boat is in motion.

Figure 9:
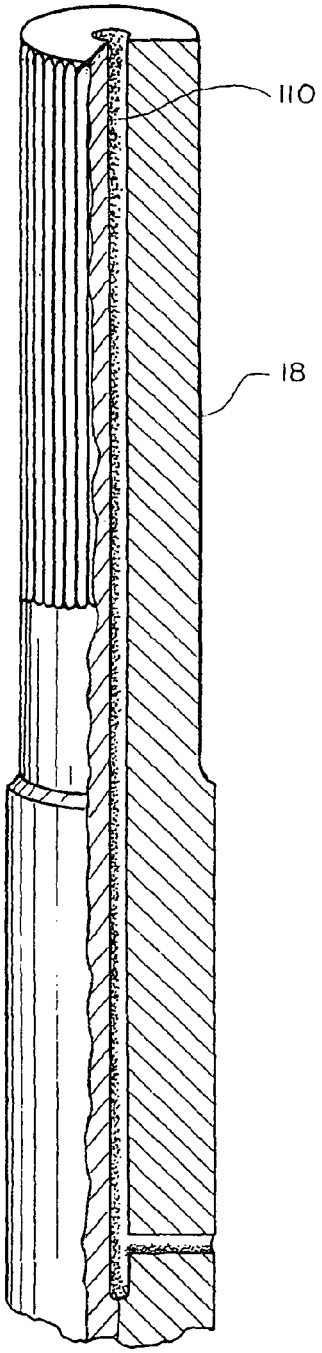
FIG. 9 is a detail view illustrating location of the pressure release channel formed in the input shaft.
Figure 8:
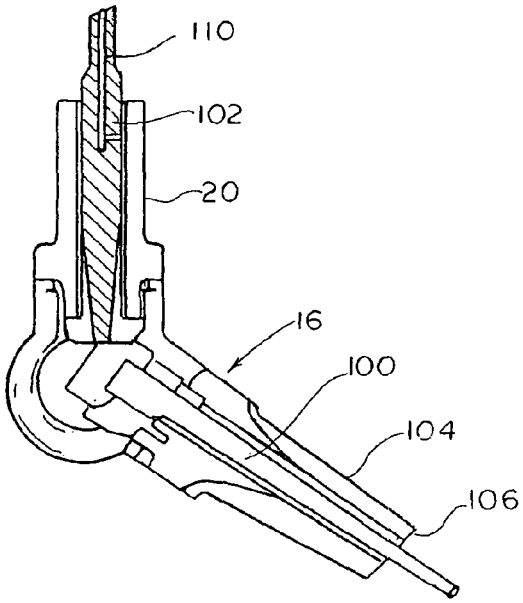
FIG. 8 is a perspective, partially cutaway view of the lower part of the outboard motor unit of the present invention illustrating location of the pressure release opening.

Turning now to FIGS. 8 and 9, the pressure release feature of the apparatus of the present invention is shown in more detail. As can be seen in the drawings, the input shaft 18 is secured within the housing 20, where it connects through conventional gear assembly to the propeller shaft 100. A seal 102 is formed in the housing 20 where the input shaft 18 extends from the housing. Another seal 106 is formed in the propeller shaft housing 104 where the propeller shaft 100 extends from the housing 104.

When the gears inside the housing 20 and 104 are in rotation, the air inside the fluidly connected sealed housings 20, 104 builds up, while the air cannot escape into the atmosphere. The present invention provides for a weep hole, or pressure release opening 110 to be formed in the input shaft 18 and to extend from a location inside the housing 20 to a location of the input shaft 18 which is normally above the water surface. As a result, hot air is allowed to escape above the water surface while the pressure inside the housings 20 and 100 are equalized with the atmosphere. Consequently, damage to the seals is prevented and water cannot leak into the housings 20, 104.

Figure 11:
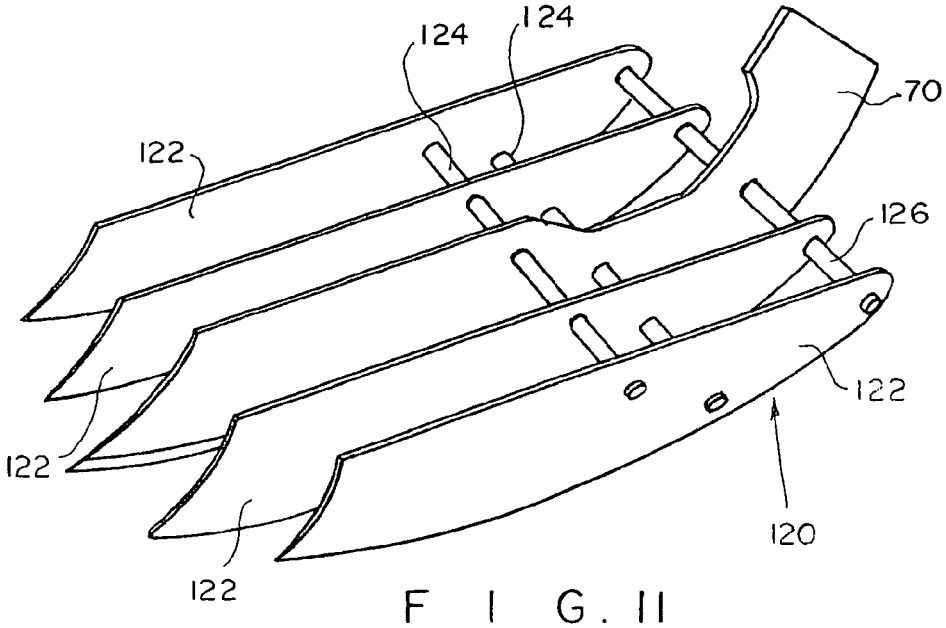
FIG. 11 is a detail view illustrating an optional propeller guard assembly for use with an outboard motor of the present invention.
Figure 12:
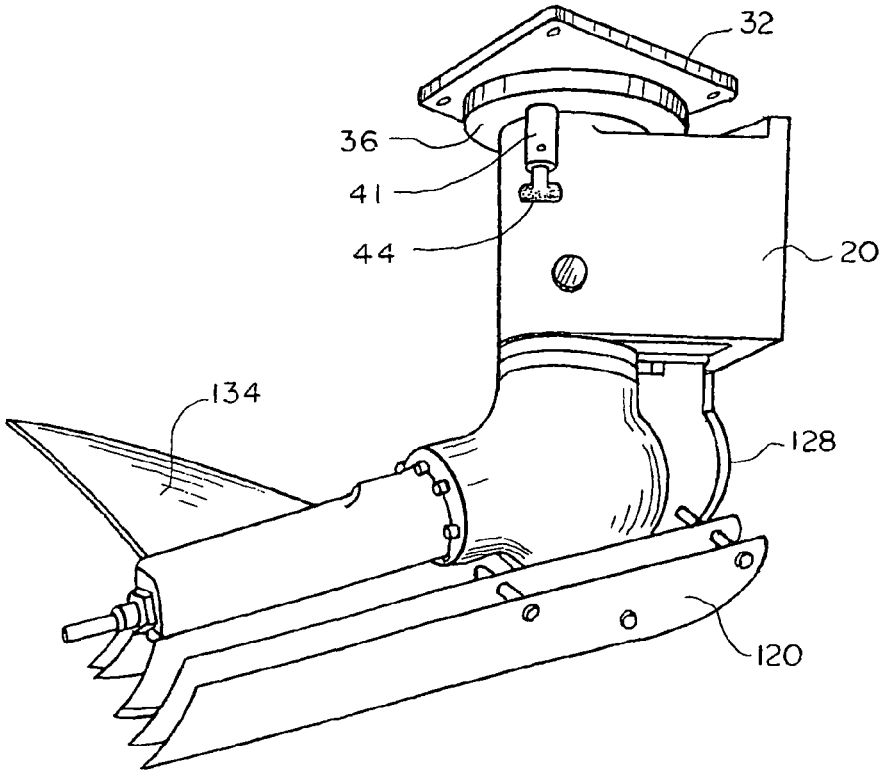
FIG. 12 is a perspective view illustrating position of the optional rock guard assembly on the lower part of the outboard motor unit.
Figure 13:
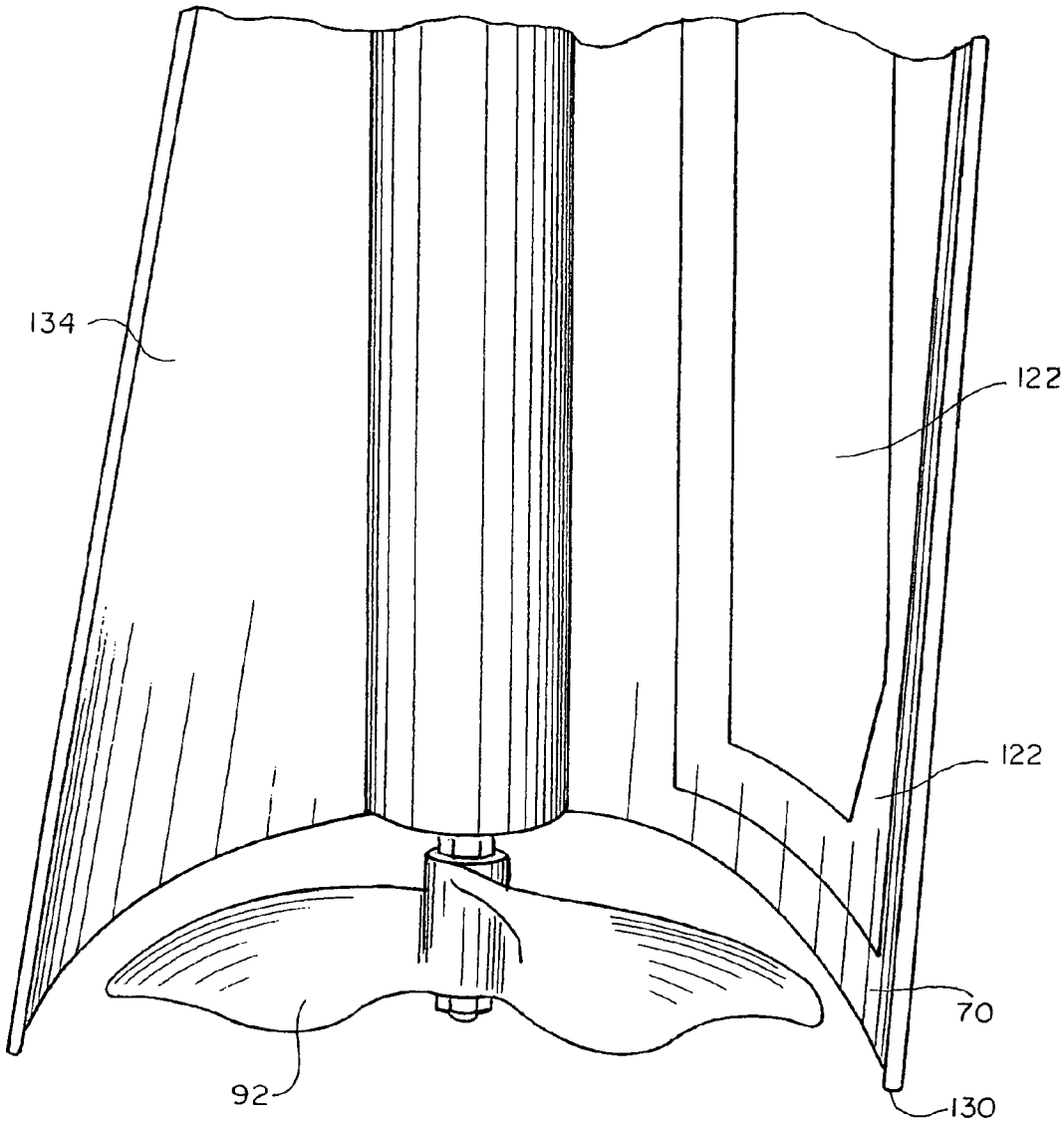
FIG. 13 is a detail view illustrating position of the rock guard assembly in a protective relationship to the propeller.

Turning now to FIGS. 11-13, an optional propeller guard assembly 120 is shown in more detail. As can be seen in the drawings, the propeller guard assembly 120 comprises a plurality of elongated flat fins 122 which are secured together with one or more traverse securing rods 124. The tins 122 are arranged in a generally parallel relationship to each other, and when secured on the skeg 70, extend in a generally parallel relationship to the normal axis of the skeg 70. An attachment rod 126 secures the propeller guard assembly 120 to a hub 128. When secured together, the rods 124 and 126 extend through corresponding aligned openings formed in the tins 122 and the skeg 70, forming a stable assembly oriented in the same direction as the skeg 70.

When the propeller guard is mounted on the lower unit 16, the propeller 92 is positioned inwardly toward the hub 128, with the outermost tips 130 of the fins 122 extending outwardly of the outer most limits of the propeller 92 and generally below the propeller 92. When the boat 25 moves through shallow waters with a rocky bottom, the fins 122 of the propeller guard assembly 120 protect the propeller 92 from damage through contact with hard bottom or other hard objects in a body of water.

The present invention offers a simple and inexpensive alternative to outboard motor units allowing a small outboard unit to propel the boat in a forward or reverse direction. The present invention is believed to be particularly advantageous when the boat moves in shallow waters full of vegetation, grass, etc. The operator can easily maneuver the boat to avoid the obstacles. Position of the propeller 92 is such that when the boat is taking off among vegetation, the propeller 92 is submerged below the water line 132. The cavitation plate 134 is above water on takeoff and acceleration, while the skeg 70 is submerged. After the boat takes off and the engine is turned to the running position and the propeller 70 is allowed to work under normal torque conditions.

The boat operates more efficiently thanks to the release of pressure through the weeping hole located above the water line, which prevents undesirable water intake while releasing hot air into the atmosphere. The propeller guard assembly can be easily positioned and detached from the lower unit 16 depending on the type of the body of water where the boat moves.

Many changes and modifications can be made in the design of the present invention without departing from the spirit thereof. I, therefore, pray that my rights to the present invention be limited only by the scope of the appended claims.

I claim:

1. An outboard drive unit adapted to be mounted on a transom of a boat, comprising:

an upper unit housing a motor with a drive shaft, said upper unit being pivotally movable in a generally horizontal plane in relation to the boat transom;

a lower unit adapted for rotation independent from the upper unit and the boat transom about an axis defined by the drive shaft, said lower unit comprising an input shaft operationally connected to the drive shaft, said lower unit comprising a propeller assembly with a propeller rotatable through connection to the input shaft, and a means for changing the shift position of the lower unit between a forward shift position and a reverse shift position when manipulated by an operator.

2. An outboard drive unit adapted to be mounted on a transom of a boat, comprising:

an upper unit housing a motor with a drive shaft, said upper unit being pivotally movable in a generally horizontal plane in relation to the boat transom;

a lower unit adapted for independent rotation in relation to the upper unit and the boat transom, said lower unit comprising an input shaft operationally connected to the drive shaft, said lower unit comprising a propeller assembly with a propeller rotatable through connection to the input shaft, and a means for changing the shift position of the lower unit between a forward shift position and a reverse shift position when manipulated by an operator, and wherein said lower unit further comprises an attachment plate secured below the motor and an engagement plate mounted above the propeller assembly, said engagement plate being adapted for a limited rotational movement with the attachment plate when the operator changes the shift position between the forward shift position to the reverse shift position.

3. The apparatus of claim 2, wherein said attachment plate and said engagement plate each have a central opening through which the input shaft extends.

* * * * *